US009273628B2

(12) United States Patent
Golya

(10) Patent No.: US 9,273,628 B2
(45) Date of Patent: Mar. 1, 2016

(54) PISTON WITH IMPROVED SIDE LOADING RESISTANCE

(71) Applicant: Performance Motorsports International, Inc., Mentor, OH (US)

(72) Inventor: Stephen Z. Golya, Mentor, OH (US)

(73) Assignee: PERFORMANCE MOTORSPORTS INTERNATIONAL, INC., Mentor, OH (US)

( * ) Notice: Subject to any disclaimer, the term of this patent is extended or adjusted under 35 U.S.C. 154(b) by 0 days.

(21) Appl. No.: 14/247,875

(22) Filed: Apr. 8, 2014

(65) Prior Publication Data

US 2014/0216247 A1 Aug. 7, 2014

Related U.S. Application Data

(62) Division of application No. 12/577,417, filed on Oct. 12, 2009, now Pat. No. 8,720,405.

(60) Provisional application No. 61/104,887, filed on Oct. 13, 2008.

(51) Int. Cl.

| | |
|---|---|
| ***F02F 3/00*** | (2006.01) |
| ***F02F 3/02*** | (2006.01) |
| *F02F 1/18* | (2006.01) |

(52) U.S. Cl.

CPC ..... *F02F 3/0069* (2013.01); *F02F 3/02* (2013.01); *F02F 1/183* (2013.01); *Y10T 29/49249* (2015.01)

(58) Field of Classification Search

CPC ..... F02F 3/00; F02F 3/02; F02F 1/83

USPC ..... 123/193.4, 193.6; 92/220, 256, 208, 92/215–217

See application file for complete search history.

(56) References Cited

U.S. PATENT DOCUMENTS

| | | | | |
|---|---|---|---|---|
| 1,073,656 A | | 9/1913 | Barker | |
| 1,514,022 A | * | 11/1924 | Smith | F16J 1/02 29/888.04 |
| 1,565,900 A | | 8/1925 | Braley | |
| 1,653,253 A | | 12/1927 | Candler | |
| 2,120,019 A | * | 6/1938 | Cooper | F02F 3/025 92/233 |

(Continued)

FOREIGN PATENT DOCUMENTS

| | | |
|---|---|---|
| CN | 1651745 | 8/2005 |
| CN | 1735763 | 2/2006 |

(Continued)

OTHER PUBLICATIONS

Notification of the First Office Action, Chinese Application No. 200980146921.6 (Nov. 30, 2012).

(Continued)

*Primary Examiner* — Marguerite McMahon
*Assistant Examiner* — James Kim
(74) *Attorney, Agent, or Firm* — Thompson Hine LLP

(57) ABSTRACT

A piston including a crown and at least one pin tower coupled to the crown. The pin tower has an opening therein configured to receive a pin therein along a pin axis. The piston further includes a skirt extending generally away from the crown, the skirt including a pair of opposed skirt panel portions. The skirt has a generally non-circular oval shape having a major axis extending generally parallel to the pin axis, wherein the panel portions are offset from the major axis.

23 Claims, 7 Drawing Sheets

(56) References Cited

U.S. PATENT DOCUMENTS

| | | | | | |
|---|---|---|---|---|---|
| 2,120,090 | A | | 6/1938 | Day | |
| 2,309,555 | A | | 1/1943 | Venner et al. | |
| 2,506,811 | A | * | 5/1950 | Rodger | F02F 3/02 92/233 |
| 2,513,814 | A | | 7/1950 | Moore | |
| 2,737,427 | A | * | 3/1956 | Venner | F02F 3/08 92/229 |
| 3,987,709 | A | | 10/1976 | Day | |
| 4,314,531 | A | * | 2/1982 | Bruni | 123/193.4 |
| 4,702,151 | A | | 10/1987 | Munro et al. | |
| 4,756,241 | A | | 7/1988 | Sakurahara et al. | |
| 4,817,505 | A | | 4/1989 | Rhodes | |
| 4,831,919 | A | * | 5/1989 | Bruni | F02F 3/022 123/193.6 |
| 4,887,519 | A | | 12/1989 | Steidle | |
| 5,058,489 | A | | 10/1991 | Iwaya | |
| 5,076,225 | A | * | 12/1991 | Tokoro et al. | 123/193.1 |
| 5,245,913 | A | | 9/1993 | Kato | |
| 5,261,321 | A | * | 11/1993 | Whitacre | F02F 1/183 92/177 |
| 5,331,932 | A | | 7/1994 | Watanabe et al. | |
| 5,476,076 | A | * | 12/1995 | Zhou | F02F 3/022 123/193.4 |
| 5,544,627 | A | * | 8/1996 | Terziev | F16J 1/14 123/197.3 |
| 5,562,074 | A | | 10/1996 | Koch | |
| 5,894,824 | A | | 4/1999 | Watanabe et al. | |
| 6,073,602 | A | | 6/2000 | Muta | |
| 6,240,828 | B1 | | 6/2001 | Fujimoto | |
| 7,406,941 | B2 | * | 8/2008 | Zhu | F02F 3/0084 123/193.6 |
| 7,614,339 | B2 | | 11/2009 | Fisher et al. | |
| 8,286,606 | B2 | | 10/2012 | Breidenbach et al. | |
| 2004/0144247 | A1 | | 7/2004 | Zhu et al. | |
| 2005/0188840 | A1 | | 9/2005 | Yasuyama | |

FOREIGN PATENT DOCUMENTS

| | | |
|---|---|---|
| CN | 101263294 | 9/2008 |
| CN | 101278117 | 10/2008 |
| FR | 869756 | 2/1942 |
| GB | 417007 | 9/1934 |
| GB | 436066 | 10/1935 |
| GB | 1002060 | 8/1965 |
| GB | 2166217 | 4/1986 |
| JP | 1104951 | 7/1989 |
| JP | 7013496 | 5/1995 |
| JP | 2009-138562 | 6/2009 |
| WO | 86/01858 | 3/1986 |

OTHER PUBLICATIONS

PCT, International Preliminary Report on Patentability, International Application No. PCT/US2009/060345 (Apr. 28, 2011).

PCT, International Search Report and Written Opinion, International Application No. PCT/US2009/060345 (Dec. 21, 2009).

"Piston Design," by University of Windsor, http://staff.washington.edu/ryanlee/Engine/UofWindsorManual/Piston%20Design.htm (Dec. 17, 2004).

* cited by examiner

PISTON WITH IMPROVED SIDE LOADING RESISTANCE

This application is a divisional of and claims priority to U.S. patent application Ser. No. 12/577,417, filed on Oct. 12, 2009, now U.S. Pat. No. 8,720,405, entitled PISTON WITH IMPROVED SIDE LOADING RESISTANCE, which claims priority to U.S. Provisional Patent Application Ser. No. 61/104,887, filed on Oct. 13, 2008, to which this application also claims priority. The entire contents of both of these applications is incorporated herein by reference.

The present invention is directed to a piston for use in an internal combustion engine, and more particularly, to such a piston with improved resistance to loading.

BACKGROUND

Pistons used in internal combustion engines are subjected to high levels of stress during operation. Accordingly, pistons are designed to have sufficient stiffness and resistance to loads. However, it is also desired to minimize weight of the piston (which improves inertial response), to reduce surface area, particularly on the radially outer surfaces (which reduces dynamic friction), and to account for various other design considerations.

SUMMARY

In one embodiment, the present invention is a piston that is designed to resist loads, particularly side loads, and may also have relatively low weight and relatively low surface area to provide improved performance. More particularly, in one embodiment the invention is a piston including a crown and at least one pin tower coupled to the crown. The pin tower has an opening therein configured to receive a pin therein along a pin axis. The piston further includes a skirt extending generally away from the crown, the skirt including a pair of opposed skirt panel portions. The skirt has a generally non-circular oval shape having a major axis extending generally parallel to the pin axis, wherein the panel portions are offset from the major axis.

DETAILED DESCRIPTION

Figure 1:
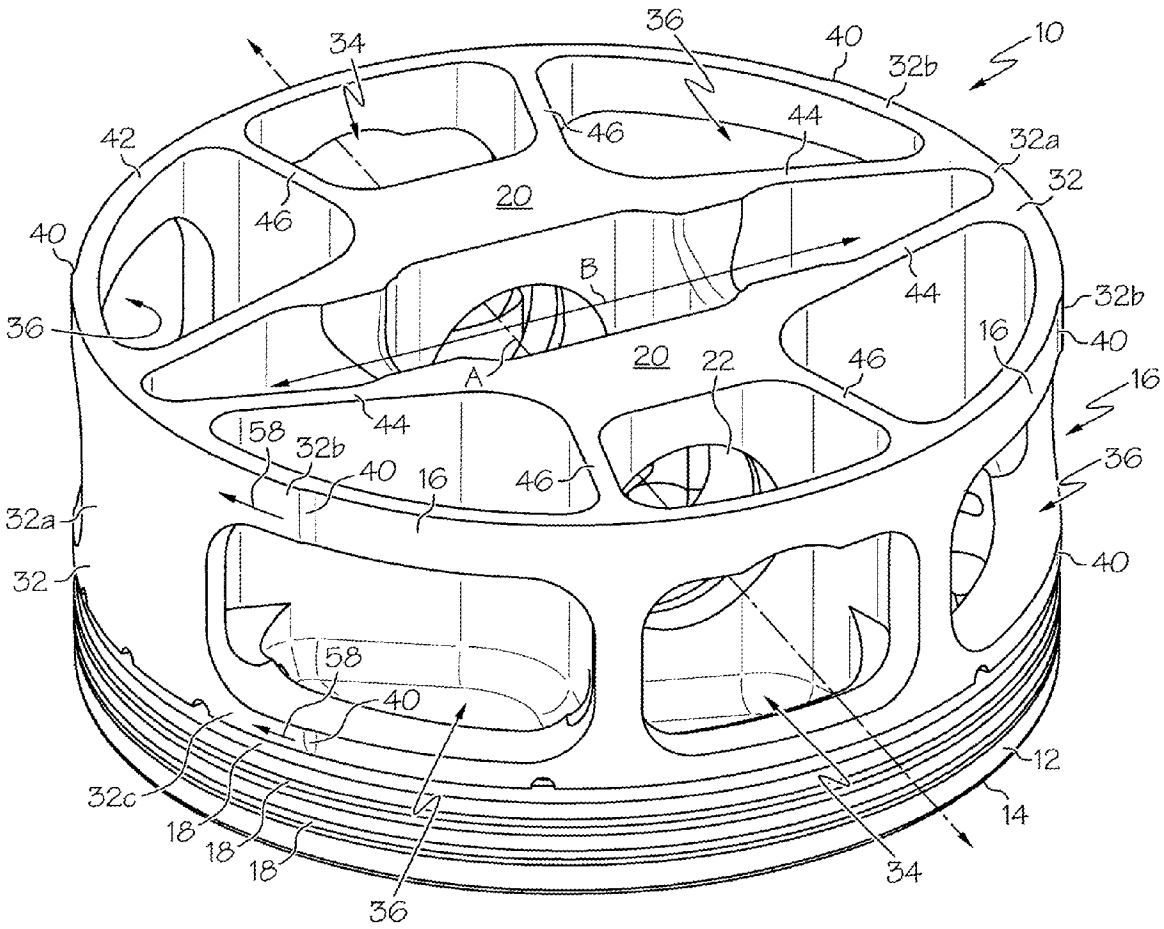
FIG. 1 is a top perspective view of one embodiment of a piston of the present invention.
Figure 2:
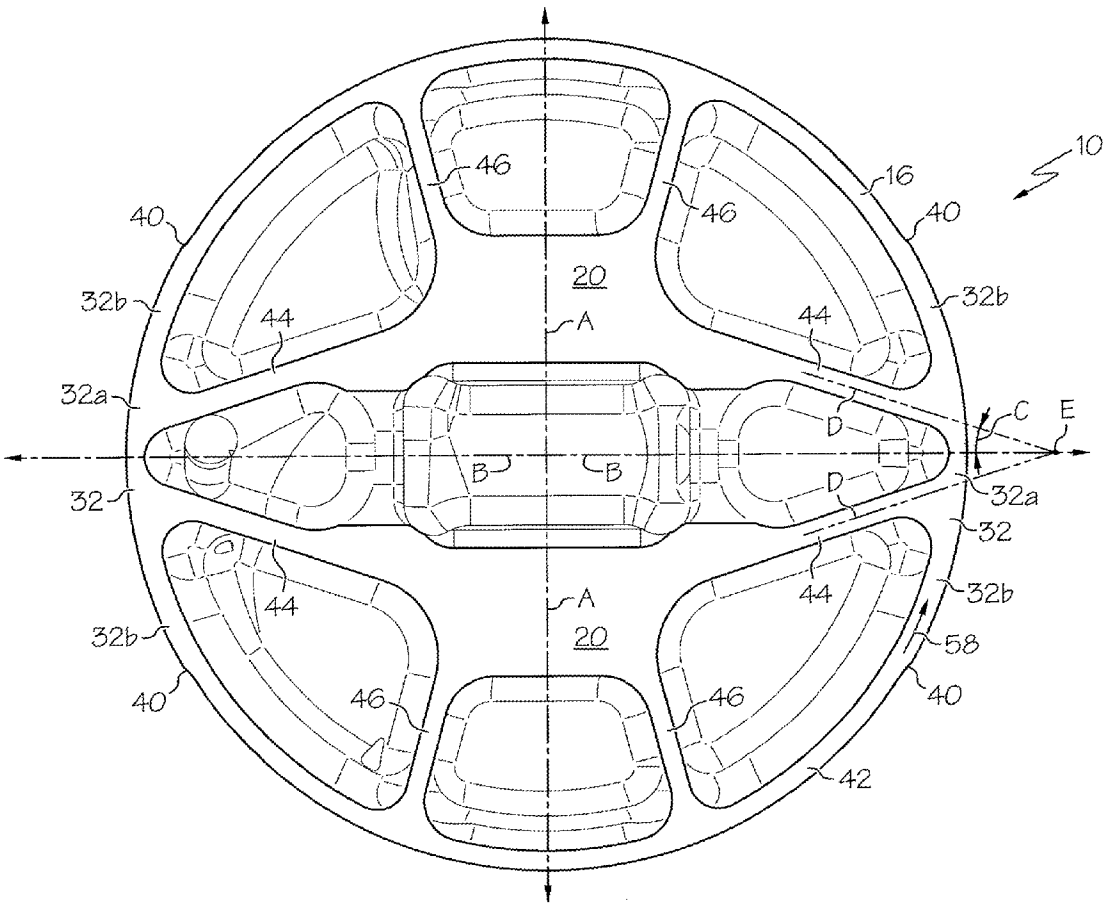
FIG. 2 is a top view of the piston of FIG. 1.
Figure 3:
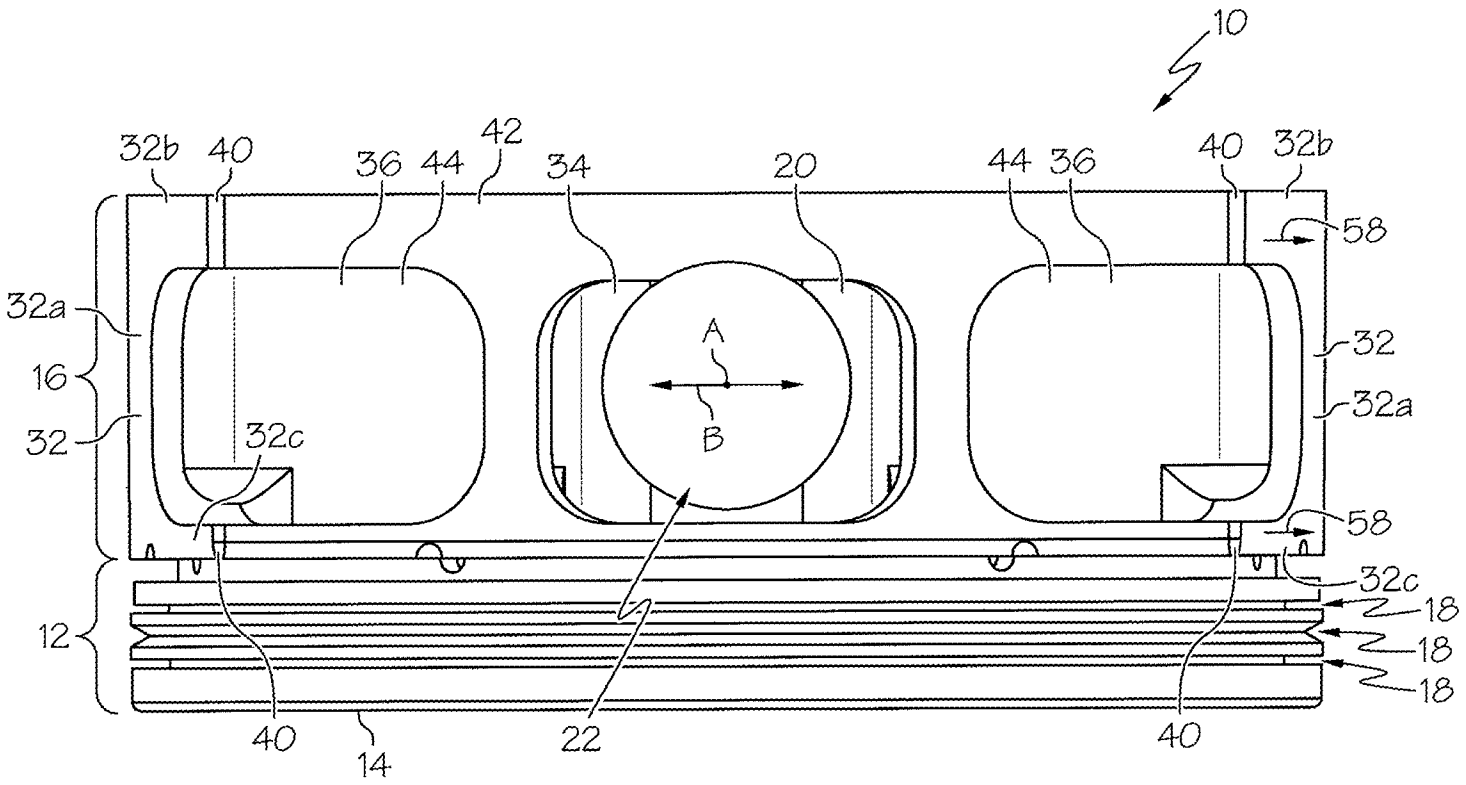
FIG. 3 is a side view of the piston of FIG. 1 along the pin axis.
Figure 5:
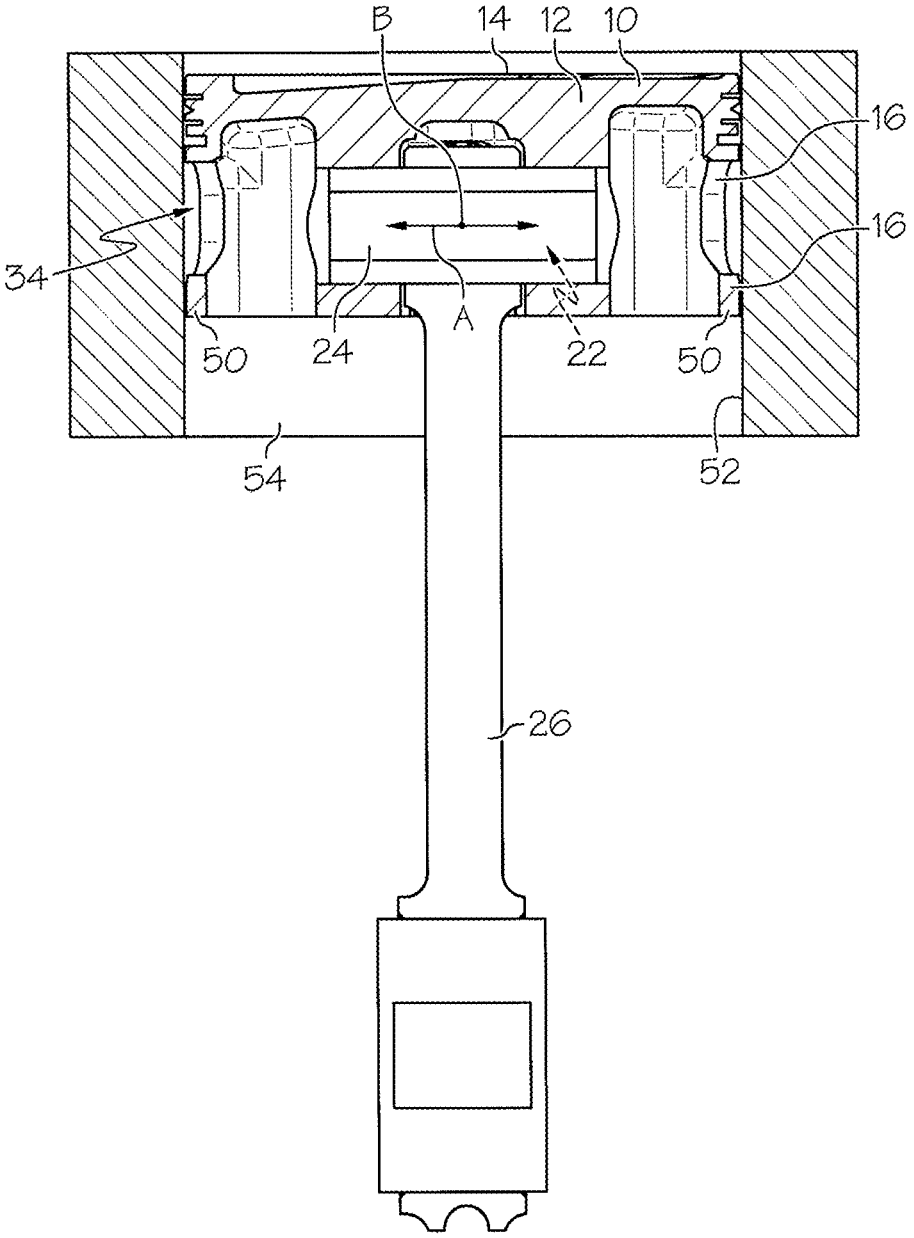
FIG. 5 is a side cross section of the piston of FIG. 3 inside a bore and attached to a rod.
Figure 6:
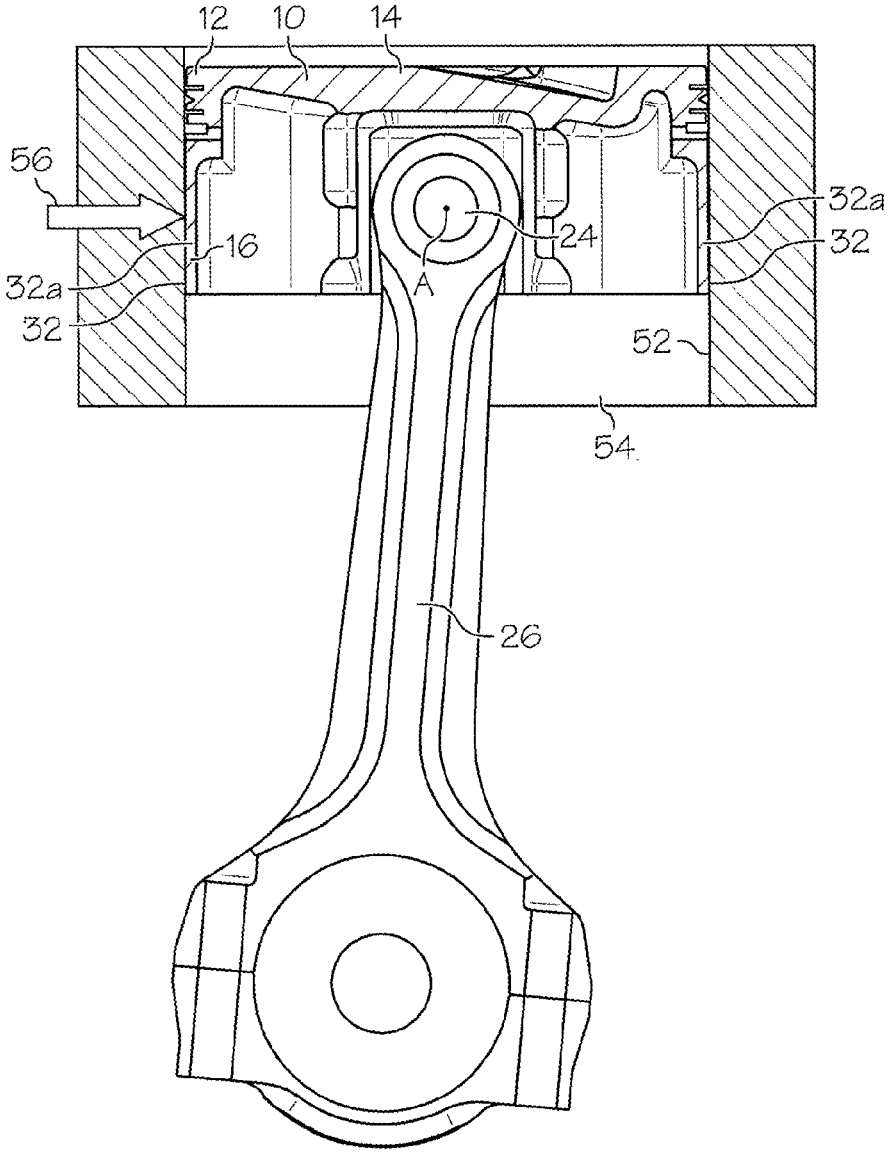
FIG. 6 is a side cross section of the piston of FIG. 4 inside a bore and attached to a rod.

As best shown in FIGS. 1 and 2, in one embodiment the piston 10 of the present invention includes a crown 12 and a skirt 16 extending generally downwardly and away from the crown 12 (it should be noted that the piston shown in FIGS. 1 and 2 is inverted from its configuration during use (shown in FIGS. 5 and 6), and therefore the "downwardly" and "upwardly" orientation used herein is opposite from the orientation that shown in FIGS. 1 and 2). The top surface 14 of the crown 12 can have any of a wide variety of configurations, such as dish, flat, domed or others, with various valve reliefs formed therein in the well known manner, but can in many cases be considered to be generally flat.

Various circumferential grooves 18 may extend around the perimeter of the crown 12, and are configured to receive various rings and scrapers therein to form a ring pack in a well known manner. The piston 10 may include a pair of pin towers 20 coupled to and/or extending generally downwardly/away from the crown 12. Each pin tower 20 has a generally circular opening 22 formed therethrough to receive a pin 24 (FIGS. 5 and 6) therethrough. The pin openings 22 define a pin axis A through their centers thereof. The pin axis A may be generally parallel to the crown 12/top surface of the piston 10. The piston 10 may also have an offset axis B which is oriented perpendicular to the pin axis A.

During the power stroke of the piston 10, the pin towers 20 transmit the combustion forces and downward movement of the piston 10 to the pin 24, and ultimately to the connecting rod 26 (FIGS. 5 and 6) and crankshaft (not shown). In addition, during the compression and exhaust strokes the pin towers 20 retain the pin 24 and crown 14 from flying upwardly toward the cylinder head. Accordingly, each pin tower 20 is typically a relatively stiff, strong structure, and together the pin towers 20 usually contribute the majority of the mass of the piston 10.

The skirt 16 may be generally annular/cylindrical and extend generally circumferentially around the entirety of the perimeter of the piston 10/crown 12. The skirt 16 may include a pair of opposed skirt panels/panel portions 32 positioned on about 180° opposite sides of the piston 10. Each skirt panel 32 is designed to accommodate side loads during operation of the piston 10 and provide alignment of the piston 10 within the cylindrical bore 54. Accordingly, each skirt panel 32 may be generally continuous, or lack any opening therethrough, and may be an area of increased thickness and/or strength and/or extend radially outwardly from the adjacent/underlying portions of the skirt 16. In the illustrated embodiment, each skirt panel 32 circumferentially extends for a total angle of about 60° about the outer perimeter of the skirt 16/piston 10, although each skirt panel 32 may extend other distances/angles, such as between about 45° and about 75°, or between about 25° and about 75°, to sufficiently resist loading without adding excessive weight and frictional resistance.

The skirt 16 may include a plurality of openings 34, 36 formed therein/therethrough. In particular, in the illustrated embodiment, the skirt 16 has a total of six openings 34, 36, including a pair of opposed pin axis openings 34, wherein each pin axis opening 34 is positioned on the pin axis A. The skirt 16 may also include two sets (pairs) of intermediate openings 36, wherein each intermediate opening 36 in a set is positioned on either side of an adjacent skirt panel 32. The number of openings 34, 36 can be varied as desired.

Figure 4:
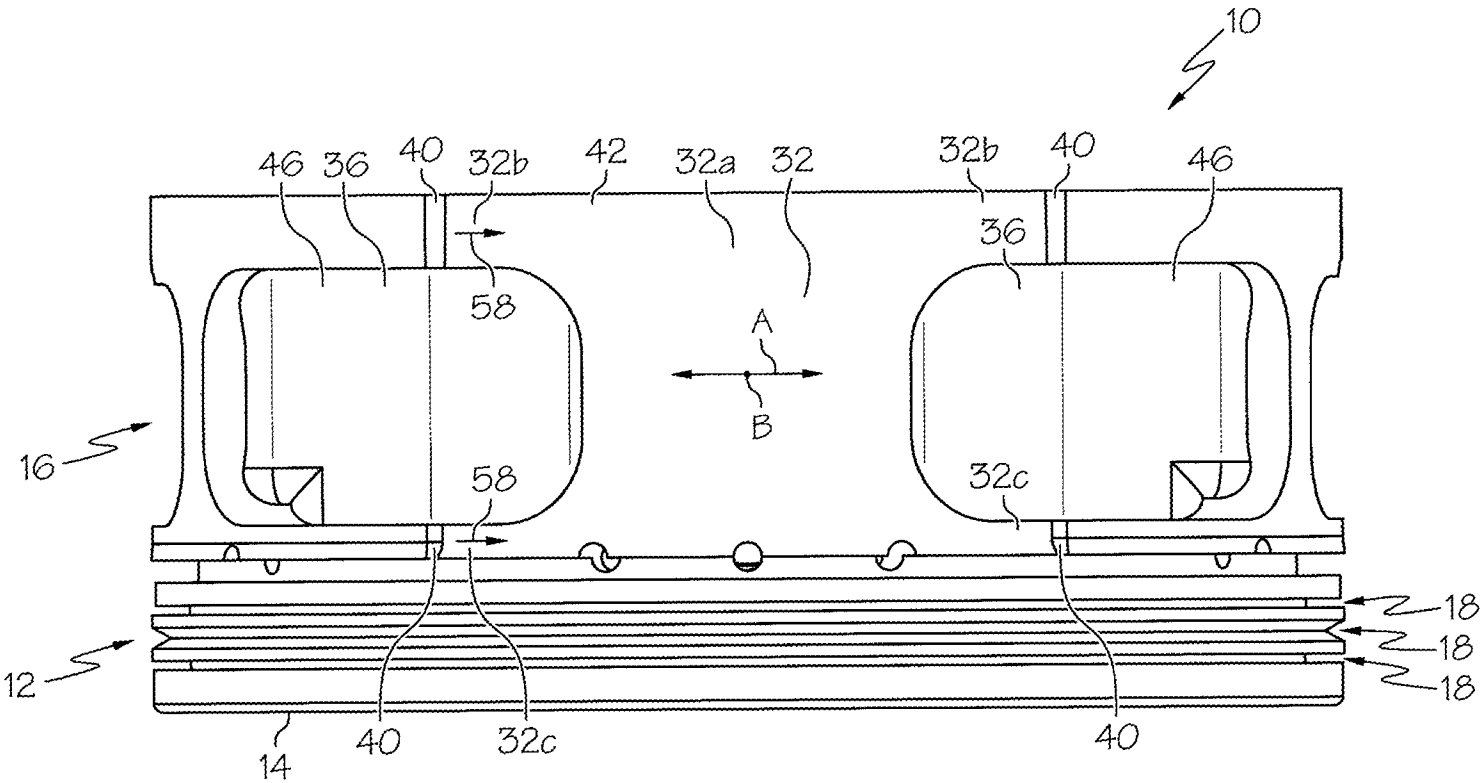
FIG. 4 is a side view of the piston of FIG. 1 along an axis that is perpendicular to the pin axis.

Each skirt panel 32 may be positioned on the offset axis B. Each skirt panel 32 may be generally "I" shaped (as best shown in FIG. 4), or generally triangular (not shown), in front view, but can also have various other shapes and configurations. In the "I" shaped configuration each skirt panel 32 has a main body portion 32*a*, pair of opposed bottom flanges 32*b* extending outwardly from the main body portion 32*a*, and (optionally) a pair of opposed top flanges 32*c* extending outwardly from the main body portion 32*a*. The main body portion 32*a* may extend generally the full axial height of the skirt 16. In contrast, each flange portion 32*b*/32*c* may be at least partially positioned below/above an associated or adjacent opening 46, and thus extend less than the full axial height of the skirt 16. As shown in, for example, FIG. 1, an angled, curved, or chamfered portion 40 may be provided as a transition between the increased thickness of each skirt panel 32 and the reduced-diameter area of the adjacent skirt 16.

The piston 10/skirt 16 may include a generally continuous hoop or band 42 extending circumferentially around the periphery of the piston 10/skirt 16. The band 42 may be located at or adjacent to a bottom edge of the piston 10; that is, at an axially opposite end of the piston 10 relative to the crown 12.

The piston 10 may include a plurality of struts 44, 46 that extend from a radially outward end of the piston, positioned at or adjacent to the band 42 and/or skirt panels 32, radially inwardly to the pin towers 20. For example, the piston 10 may include a pair of stiffening members or converging strut assemblies, wherein each converging strut assembly includes a pair of struts 44 that converge in the radially outward direction. As shown in FIG. 2, each converging strut 44 may form an acute angle C with respect to the offset axis B. The angle C can vary as desired, but in one case is between about 10° and about 35°.

Each converging strut 44 may terminate (i.e. at its radially outward end) at or adjacent to an associated skirt panel 32 and, more particularly, at or adjacent to the circumferential center of the skirt panel 32. The converging struts 44 may be configured such that a centerline D drawn through each converging strut 44 intersect at a position E that is positioned outside of but relatively close to the associated skirt panel 32. In particular, the distance between the intersection point E and the skirt panel 16 (i.e., along the offset axis B) may be less than ½ or ¼ of the average radius of the piston 10, or more particularly, less than about ⅛ of the average radius of the piston 10. As will be described in greater detail below, in may be desired to relatively closely position point E relative to the skirt panels 32 so that the struts 44 provide their greatest support at or adjacent to the center of the skirt panel 32. However, it should be noted that a variety of configuration of struts 44 may be utilized to provide support to the skirt panels 32, including struts that diverge in a radially outward direction, struts that neither converge or diverge in a radially outward direction, the use of single strut, etc.

The piston may include two or more sets (or pairs) of supplemental struts 46. Each supplemental strut 46 may have a radially outward end positioned adjacent to an the end of associated pin axis opening 34, and extend radially inwardly to an associated pin tower 20. In the illustrated embodiment each supplemental strut 46 diverges from the associated other supplemental strut in the radially outward direction. However, it should be noted that a variety of configuration of struts 46 may be utilized, including struts 46 that converge in a radially outward direction, struts that neither converge or diverge in a radially outward direction, etc. Each strut 44, 46 may extend generally the full axial height of the piston 10; i.e. such that each strut 44, 46 is not a triangular "buttress-style" strut; although in some cases buttress-style struts may be used.

Figure 7:
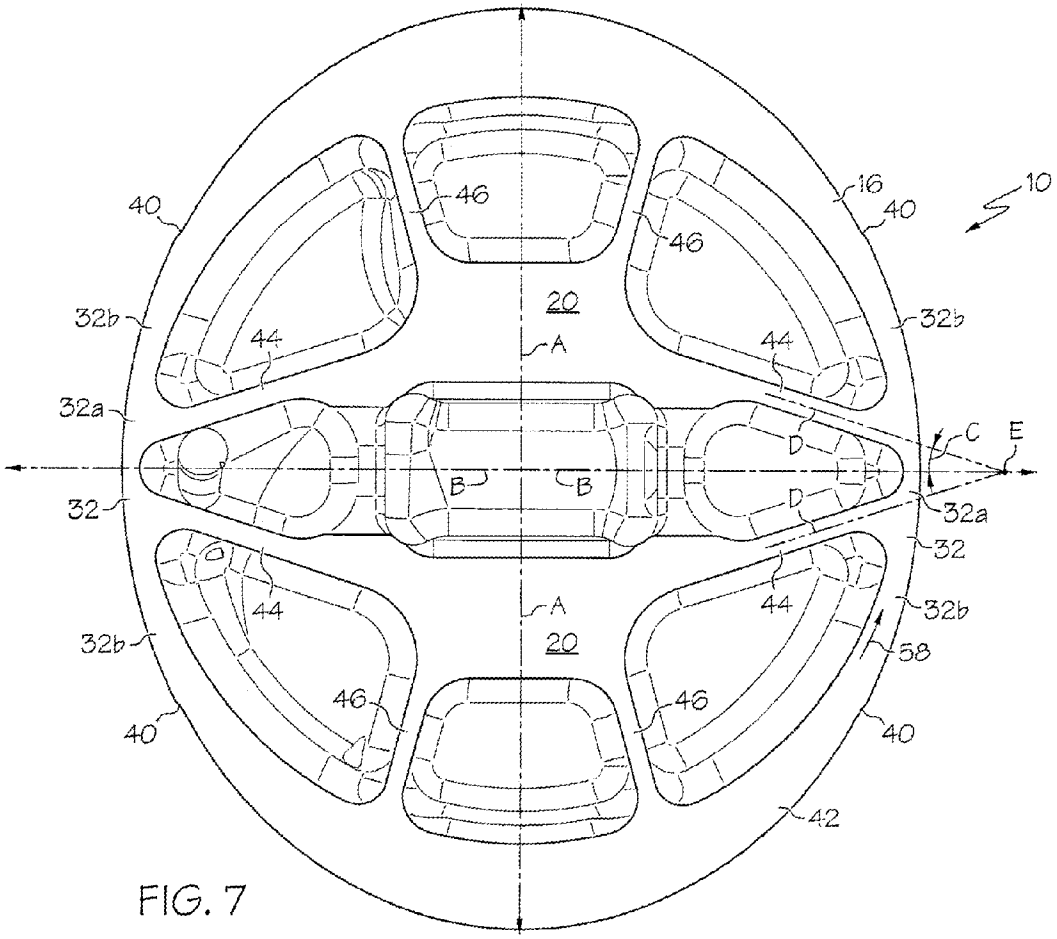
FIG. 7 is a top view of another embodiment of the piston.

The piston 10, including the crown 12, skirt 16, and/or band 42, may be circular in top view, or may be of a non-circular shape in top view (see FIG. 7), such as oval or elliptical (wherein "oval" as used henceforth shall include ellipses, elliptical shapes, non-elliptical ovals and the like; and wherein "oval" includes circular as a subset thereof). In some cases, the piston 10 may have a uniform outer top-to-bottom shape (i.e. in the axial direction from the crown 12 to the bottom of the skirt 16/band 42). Alternatively, the outer shape of the piston 10 may vary along its the axial height. For example, various portions of the piston 10 may have various shapes and dimensions, such as circular, circles with varying diameters, ovals, ovals having varying diameters (including varying major and minor diameters), etc.

In one embodiment, the crown 12, skirt 16 and/or band 42 are of a uniform oval shape having a major axis (i.e., of a greater relative length) oriented generally parallel to the pin axis A, and a minor axis (i.e., of a lesser relative length) oriented generally perpendicular to the pin axis A (i.e., aligned with the offset axis B). Although it may vary, the ratio between the major axis and the minor axis may be between 1.4:1 and 1.05:1, or between 1.4:1 and 1:1 to provide the advantages described below.

The band 42, struts 44, 46, and elliptical/oval shape or other configuration provide certain advantages, and together cooperate to improve performance and stiffness of the piston. In particular, as noted above, the piston 10/skirt 16 may have an oval configuration in which the major axis is oriented parallel to the pin axis A. During operation, the piston 10 is reciprocated up and down but also tends to move laterally (so-called secondary motion or rocking) in the direction of the offset axis B (i.e. as the pin 24 pivots about the pin axis A; see FIGS. 5 and 6). However, since the radially outward end of the chamfer 40 A may protrude outwardly further than any other points on the piston 10 (due to the increased thickness of the skirt panels 32 and the orientation of the oval shape), the chamfer 40 may receive the initial side loads as the piston 10 bears upon the side walls or body 52 of the bore 54 (since the chamfer is positioned closer to the (longer) major axis A than other portions or the protruding skirt panel 32).

Only one side of the skirt 16 may initially engage the wall 52 in a single stroke. Alternately, more than one initial contact point may occur, or additional points of contact between the skirt 16 and wall 52 may arise during continued movement/deformation of the piston 10. Moreover, it should be noted that the initial contact between the skirt 16 and the wall 52 may not always occur at an chamfer 40. Depending upon the orientation of the piston 10 and the applied forces, the initial contact may take place at various other positions around the perimeter of the skirt 16.

Due to the intermediate openings 36 formed in the skirt 16, and other designed features along the skirt 16, the skirt 16/band 42 may be configured to be relatively easily deformed at the initial point of contact 40. The relative flexibility of these portions of the skirt 16 thereby causing the skirt 16 to conform to the inner surface 52 of the bore 54. Accordingly, as increased forces are applied (i.e., the piston 10 is continued to be moved in a stroke) the deformation of the skirt 16 increases/expands/moves circumferentially away from the initial point of contact 40 in the direction as shown by arrow 58 in FIGS. 1-4.

The chamfered/angled edges 40 adjacent to the skirt panels 32 help to guide deformation of the piston 10 such that the skirt panel 32 is smoothly deformed against the bore surface 52. Thus, each chamfered edge 40 may be considered a guide surface that guides the increasing or greatest stresses toward the center of the skirt panel 32. The initial area of contact provided by the chamfered edge 40/flanges 32*b*, 32*c* also help to triangulate the piston 10 within the bore 54 and thereby provide several points of contact to guide piston 10 in its reciprocal movement and reduce piston rocking The circumferential extent of each skirt panel 32, and/or its flanges 32*b*, 32*c*, can be adjusted to provide for desired triangulation characteristics for the piston 10 to reduce secondary motion.

As the deformation of the skirt 16 expands around its perimeter (i.e., in the direction of arrow 58), the leading edge of deformation/contact eventually reaches the main body 32*a* of the skirt panel 32. Thus, generally all side loading forces applied to the skirt 16, wherever initially applied, are eventually guided circumferentially toward the main body 32*a* upon the application of sufficient force. Due to the increased stiffness contributed by the main body 32*a*, continued deformation of the skirt 32 is more strongly resisted. However, upon the application of sufficient forces, the center of each skirt panel 32 is pressed into contact with the bore surface 52, which thereby ensures that the greatest side loads are applied to the circumferential center of the skirt panel 32 (see arrow 56 in FIG. 6).

As noted above, each converging strut 44 terminates at or adjacent to the center of the associated skirt panel 32. In this manner, when the greatest loads 56 are applied to the center of the skirt panel 32, the converging struts 44 provide resistance and transmit side loading stresses to the relatively strong, stiff pin towers 20. In this manner, the converging struts 44 provide the greatest stiffness at the point at which the greatest loads are typically applied. The skirt panels 32 may also be configured to relatively even spread side loads across their surfaces to minimize high stress/force concentrations.

In addition, the band 42 extends circumferentially around the lower edge of the skirt 16, connecting the skirt 16 and all of the struts 44, 46 together, thereby providing structural integrity to the piston 10. The increased stiffness provided by the band 42 and struts 44, 46 may enable the thickness of the crown 12 to be reduced, thereby providing cost savings and reduced mass to enable increased inertial response of the piston 10. The increased stiffness may also reduce stress peaks and stress concentration on the undercrown of the piston 10 (i.e. wherein the pin towers 20 and struts 44, 46 are attached to the crown 12).

In addition, since the stiffness provided by the band 42 and struts 44, 46 creates a more robust piston 10, the size of the skirt panels 32 may be able to be correspondingly reduced, thereby further reducing weight and frictional forces during use of the piston 10. Moreover, reduction of thickness of the crown 12 and the size of the skirt panels 32 helps to ensure that more weight of the piston 10 is positioned closer to the pin axis A, thereby providing a more stable piston assembly. Finally, an improved temperature distribution across the piston 10, particular across the top surface 14, may be provided, which reduces thermal stress concentrations within the crown 12.

It should be noted that when the piston 10 is oval, the orientation of the oval described herein is opposite to that of typical design. In particular, in many conventional piston designs, the major axis of the oval is perpendicular to the pin axis. This configuration is used since side loading forces are, in that case, initially applied to the ends of the piston that are at positions perpendicular to the pin axis A, which is where the load-resisting side panels are positioned. Thus, such a configuration is designed to resist the initial side loads.

In contrast, the oval design disclosed herein operates on completely different principles and is designed to resist maximum (and not necessarily initial) side loads. In particular, instead of applying the load initially to the center of skirt panels (which would then be required to deform to distribute the load), the load is initially applied away from the center of the skirt panels (i.e. at the area of initial contact 40) at relatively weaker/more deformable areas of the skirt 16. These areas of the skirt 16 then deform to ultimately distribute the load to the center of the skirt panels 32, which are designed to be inherently stiff and resist deformation.

Thus, in sum, side loads are typically relatively low at the beginning of a stroke, and increase to some peak level during a stroke. In this manner, initial contact may begin at the initial contact points 40, or some other position, or even multiple positions, and move circumferentially around the piston 10 such that the greatest side load forces 56 are applied across the center of a skirt panel 32. The shape of the piston 10, and the ratio of the major and minor axes, taking into account the deflection of the skirt 16 and the thickness of the skirt panels 32, must be carefully selected to ensure that with sufficient deformation the largest side loads are applied to the skirt panels 32. In this manner, the highest concentration of loading can be resisted by the inherently stiff skirt panels 32 that are not designed or intended to be deflected. Moreover, the converging struts 44 help increase the stiffness at the center of the skirt panels 32, and the band 42 helps to provide continuity between all the struts 44, 46 and pin towers 32 to create a robust piston design.

Having described the invention in detail and by reference to the various embodiments, it should be understood that modifications and variations thereof are possible without departing from the scope of the invention.

What is claimed is:

1. A piston comprising:

a crown;

at least one pin tower coupled to said crown, said pin tower having an opening therein configured to receive a pin therein along a pin axis; and a skirt extending generally away from said crown and having an outer perimeter, said skirt including a pair of opposed skirt panel portions, said skirt having a generally non-circular oval shape having a major axis extending generally parallel to said pin axis and having an offset axis offset from said major axis, wherein a first dimension of said skirt from a first position on said outer perimeter to a second, opposite position on said outer perimeter along said major axis is longer than a second dimension of said skirt from a third position on said outer perimeter to a fourth, opposite position on said outer perimeter along said offset axis, wherein said panel portions are offset from said major axis, and wherein said skirt is configured such that said first dimension is longer than said second dimension along substantially an entire height of said skirt.

2. The piston of claim 1 wherein said panel portions are aligned along said offset axis which is oriented generally perpendicular to said pin axis.

3. The piston of claim 2 wherein each panel portion has a surface area which generally decreases at positions away from said offset axis.

4. The piston of claim 1 wherein each panel portion extends radially outwardly relative to other adjacent areas of said skirt.

5. The piston of claim 1 wherein each panel portion provides greater resistance to radial loads than other adjacent areas of said skirt.

6. The piston of claim 1 further including a transition portion configured to first engage a bore when said piston is placed in said bore for reciprocation therein, wherein said piston is configured such that additional movement of said piston in said bore after said first engagement causes additional contact between said piston and said bore, said additional contact increasing or moving in a circumferential direction about said piston, wherein said piston is configured such that maximum side loading forces from said bore to said piston are applied to said piston at one of said panel portions.

7. The piston system of claim 6 wherein said transition portion is at least partially spaced away from each panel portion, and wherein said transition portion extends smoothly from an area of lesser radial extent to an associated panel portion.

8. The piston system of claim 6 wherein each panel portion has a transition portion on each opposite end thereof, and wherein each transition portion takes the form of a chamfered surface positioned adjacent to one of said panel portions.

9. The piston system of claim 6 further include said bore, and wherein said piston is positioned in said bore for reciprocation therein.

10. The piston system of claim 1 wherein said piston further includes a stiffening structure positioned at each panel portion, each stiffening structure being configured to resist deformation of said piston in a direction generally aligned with said offset axis.

11. The piston system of claim 10 wherein each stiffening structure includes a pair of strut assemblies, each strut assembly including a pair of struts which converge in a radially outward direction, wherein each strut terminates at or adjacent to one of said panel portions.

12. The piston system of claim 1 wherein each panel portion extends between about 25 degrees and about 75 degrees about said piston, and lacks any openings extending therethrough, wherein said crown is a generally flat, axial end surface of said piston, and wherein said piston includes a circumferentially-extending band positioned on an opposite side of said piston relative to said crown.

13. The piston system of claim 1 wherein said skirt is generally annular and extends around an outer perimeter of said crown and wherein each panel portion is generally continuous.

14. A piston configured to receive a pin therein along a pin axis, said piston having an outer perimeter and a generally non-circular oval shape having a longest, major dimension defined at either end thereof by said outer perimeter and extending generally parallel to said pin axis, wherein said piston has said generally non-circular oval shape having said longest, major dimension extending generally parallel to said pin axis at all cross sections of said piston.

15. The piston of claim 14 further including a pair of opposed panel portions, wherein said panel portions are offset from said major dimension.

16. The piston of claim 15 wherein said panel portions are aligned with an axis generally perpendicular to said pin axis.

17. The piston of claim 14 further including a pair of stiffening structures, each stiffening structure being configured to resist deformation of said piston in a direction generally perpendicular to said major axis.

18. The piston of claim 1 wherein said height extends generally parallel to a central axis of said piston, perpendicular to a plane defined by said major axis and said offset axis.

19. The piston of claim 1 wherein said skirt has a substantially uniform outer perimeter shape along an entire height of said skirt.

20. The piston of claim 1 wherein said skirt has a first radius extending along said major axis and a second radius extending along said offset axis, and wherein said first radius is longer than said second radius.

21. A piston configured to receive a pin therein along a pin axis, said piston having an outer perimeter and a generally non-circular oval shape having a longest, major dimension defined at either end thereof by said outer perimeter and extending generally parallel to said pin axis, said piston including a pair of stiffening structures, each stiffening structure being configured to resist deformation of said piston in a direction offset from said major axis.

22. The piston of claim 21 wherein each stiffening structure is configured to resist deformation of said piston in a direction generally perpendicular to said major axis.

23. The piston system of claim 21 wherein each stiffening structure includes a pair of strut assemblies, each strut assembly including a pair of struts which converge in a radially outward direction, and wherein each strut terminates at or adjacent to said outer perimeter.

* * * * *